US008359685B2

(12) United States Patent
Patwardhan

(10) Patent No.: US 8,359,685 B2
(45) Date of Patent: Jan. 29, 2013

(54) WHEELCHAIR WITH A COMMODE THAT CONVERTS INTO A BED

(76) Inventor: Bhaskar Vitthal Patwardhan, Maharashtra (IN)

( * ) Notice: Subject to any disclaimer, the term of this patent is extended or adjusted under 35 U.S.C. 154(b) by 300 days.

(21) Appl. No.: 12/668,401

(22) PCT Filed: Jun. 26, 2008

(86) PCT No.: PCT/IN2008/000407

§ 371 (c)(1),
(2), (4) Date: Apr. 22, 2010

(87) PCT Pub. No.: WO2009/050732

PCT Pub. Date: Apr. 23, 2009

(65) Prior Publication Data

US 2010/0199422 A1 Aug. 12, 2010

(30) Foreign Application Priority Data

Jul. 8, 2007 (IN) ..... 884/MUM/2007

(51) Int. Cl.
*A61G 5/10* (2006.01)

(52) U.S. Cl. ..... 5/618; 5/86.1; 5/604; 5/185

(58) Field of Classification Search ..... 5/86.1, 5/604, 618, 181, 185; 297/61, 284.7, 353
See application file for complete search history.

(56) References Cited

U.S. PATENT DOCUMENTS

| | | | | |
|---|---|---|---|---|
| 1,261,040 | A * | 4/1918 | Lanes | 297/68 |
| 2,915,112 | A | 12/1959 | Schwartz | |
| 3,191,990 | A * | 6/1965 | Rugg et al. | 297/83 |
| 4,105,242 | A | 8/1978 | Terbeek | |
| 4,676,550 | A * | 6/1987 | Neve De Mevergnies | 297/353 |
| 5,634,688 | A * | 6/1997 | Ellis | 297/358 |
| 6,154,899 | A * | 12/2000 | Brooke et al. | 5/81.1 R |
| 6,886,194 | B2 * | 5/2005 | Hodgetts | 5/86.1 |
| 8,104,121 | B2 * | 1/2012 | Bourgraf et al. | 5/618 |

FOREIGN PATENT DOCUMENTS

| | | |
|---|---|---|
| DE | 37 30 669 A1 | 3/1989 |
| EP | 1 430 862 A | 6/2004 |

OTHER PUBLICATIONS

International Search Report for International Application No. PCT/IN2008/000407, published Jul. 23, 2009.

* cited by examiner

*Primary Examiner* — Michael Trettel
(74) *Attorney, Agent, or Firm* — Fay Sharpe LLP

(57) ABSTRACT

A wheel chair with commode for a patient that coverts in to a bed is disclosed. The wheel chair includes an outer rectangular main frame standing on at least four wheeled legs, first, second, third, and four outer frame being connected to each other by pivots or hinges, a pair of additional wheels being connected to the third frame by means of links that prevent the chair or bed from tilting backward due to weight of first and second frames and the patient, a means for making movements of the first, second, third and fourth frames to convert chair into bed or vice-versa, inner frames being slidably fitted inside the outer frames, and a commode pan or pot being fitted under the main frame, wherein a cushion is provided between said main frame and commode pan or pot.

13 Claims, 12 Drawing Sheets

WHEELCHAIR WITH A COMMODE THAT CONVERTS INTO A BED

FIELD OF THE INVENTION

This invention relates to a multipurpose wheel chair for patients. More particularly it relates to a wheel chair with commode which can convert in to a bed.

BACKGROUND

Lifting and shifting of a disabled/bedridden person has always been difficult, risky and problematic. This lifting and shifting is dangerous and painful for the disabled person if done by the untrained person. The patients are scared of this procedure, as there is a danger of slipping and falling and getting injured.

This lifting and shifting is strenuous for the nurse. When he/she is trying to lift the patient, he/she has to bend over the patient to lift him. This posture in the long run gives the nurses a back pain and can turn into permanent back problems. A lot of medical literature is available on back problems of nurses as it is very common in nurses.

A disabled person mainly needs to be shifted from a bed to change the bed or bed sheet. The person also needs to be lifted when putting a bed pan under him. This lifting and shifting is painful and dangerous for the disabled/bedridden person.

Many lifting and shifting apparatuses are available in the market. All these apparatus are expensive and unpractical at home as it takes a lot of space and a lot of training for the user. In hospitals some help is available but at home one is helpless and finds lifting and shifting very difficult.

It has been observed that it is very difficult to nurse bedridden persons, the main difficulties are:

i. shifting of patient from bed to wheel chair for transport;
ii. shifting of patient from wheel chair to bed for sleeping or rest; and
iii. sifting the person for putting bed pan under him.

JP10179645 provides wheel chair for nursing care. This wheel chair for nursing care consists of an L-shape supporting frame equipped with a holding frame and a pedestal and a truck on which the frame is installed. The truck has casters which can freely move around in all directions, and is of such a height as to allow itself to be introduced into a space below a bed for nursing care. In addition, the truck has a lift drive device mounted on the lateral part and also is of such a U-shape that one of the sides is open. Therefore, a patient can be positioned right above a stool in such a way that the truck 4 holds the stool. Besides, an ordinary-type flat truck can be used and also a motor-driven truck can be applied to this wheel chair. The lift drive device is constructed of a cylinder or a rack/pinion mechanism, or chain or motor-driven.

DE10241008 provides a wheel chair has a telescopic frame to provide continuously adjustable wheelbase, setting holes to give adjustable distance between pivoted wheel axis and frame and an adjustable seat position in the frame fork.

Also the wheel chair available in the market is used only for shifting purpose. It is not provided with bed facility. Also it does not have commode facility.

Hence there is a need of an improved wheel chair cum bed where lifting & shifting is eliminated. As this apparatus itself converts from bed to chair and vice-versa, the patient does not need to be shifted from bed to chair or vice-versa. This improved apparatus for a patient which will address and overcome all the problems of the wheel chair or bed or lifting & shifting apparatus of the prior art.

It is a common fact that all the patients on fouler (back straitening) bed slide down with the operation of the backrest. They have to be pulled up every day and that is strenuous for nurse or family members and painful for the patient.

This sliding forward of patient happens because as the back is strained the patient is pushed forward as there is no sliding movement between the patient and the back frame.

In the available equipment there is no arrangement to stop this pushing. The patient is pushed forward and so slides towards his feet. As a result he has to be pulled up when the back of the bed goes into bed position as it does not pull the patient up but goes does down to bed position so the patient remains in the pushed forward position. In the available equipment nothing is available to solve this problem.

The primary object of the present invention is to provide a wheel chair and bed where lifting & shifting is eliminated. Such apparatus for a patient which will address and overcome all the problems of the chair or bed or lifting & shifting apparatus of the prior art.

Another object of the present invention is to provide a wheel chair and bed where lifting & shifting is eliminated and such apparatus for a patient which will be used as a chair as well as bed also.

Yet another object of the present invention is to provide a wheel chair and bed where lifting and shifting of patient is eliminated.

Yet another object of the present invention is to provide a wheel chair and bed where lifting & shifting is eliminated and this apparatus for a patient which has the built in commode.

To overcome this problem a need was felt to invent some mechanism, which will:

1. Stop pushing the patient forward (towards legs);
2. Will save the energy of nurse and make their life easy; and
3. The patient will not have to go through the painful procedure.

SUMMARY OF THE INVENTION

Embodiments are disclosed herein as illustrative examples. In one embodiment there is provided a wheel chair with commode for a patient that converts into a bed comprises: an outer rectangular main frame standing on at least four wheeled legs, the frame supporting the hip portion of the patient's body and four outer frames being connected to each other by pivots or hinges. Out of these four frames, the first frame supports the head portion of the patient's body, the second frame supports the upper body portion of the patient's body, the third frame supports the leg portion of the patient's body, the fourth frame supports the foot portion of the legs of the patient's body. The main frame is placed between the second and third frames. The first frame is connected to the rear legs of the main frame through a link and to a second frame by a hinge. The second frame is connected to the third frame through another link, and the third and fourth frames are connected to each other by a hinge. The fourth frame is provided with a caster wheel below it. The wheel chair further includes a pair of additional wheels being connected to the rear legs of the third frame by means of links. The links pull the additional wheels either nearer to or farther away from the rear wheels of said main frame. The additional wheels prevent the chair or bed from tilting backward due to the weight of the first and second frames and the patient. A means for making movements of the first, second, third and fourth frames to convert chair into bed or vice-versa is attached to the main frame from down side and comprises a gear box along with gears or cables. Additionally, the wheel chair includes an inner frames being slidably fitted inside the outer frames. The inner frames are pulled inside the outer frames during use of wheel chair as a chair and pulled outside while using wheel chair as a bed to increase the dimension (width) of the bed, and a commode pan or pot being fitted under the main frame with the help of hinge and linkage arrangement. A cushion is provided between the main frame and commode pan or pot, the position of commode pan or pot and cushion is controlled by a pair of gear boxes in which one is provided near commode pan or pot and other is at the rear wheels of the outer main frame.

According to another embodiment of the invention the outer frames are made up of hollow square pipes.

According to another embodiment of the invention the movement of the inner frame is controlled by the threaded rods, which are attached to the frames by means of steel strips and rivets or nut bolts. All threaded rods of inner frames are connected by a chain and handle assembly, so that they all turn together, when handle is turned. All inner frames can be moved separately driven mechanically, electrically with electric motor, pneumatically with pneumatic force or hydraulically with hydraulic force.

According to yet another embodiment of the invention gearboxes can be operated mechanically, electrically with electric motor, pneumatically with pneumatic force or hydraulically with hydraulic force.

DETAILED DESCRIPTION OF THE INVENTION

Figure 1:
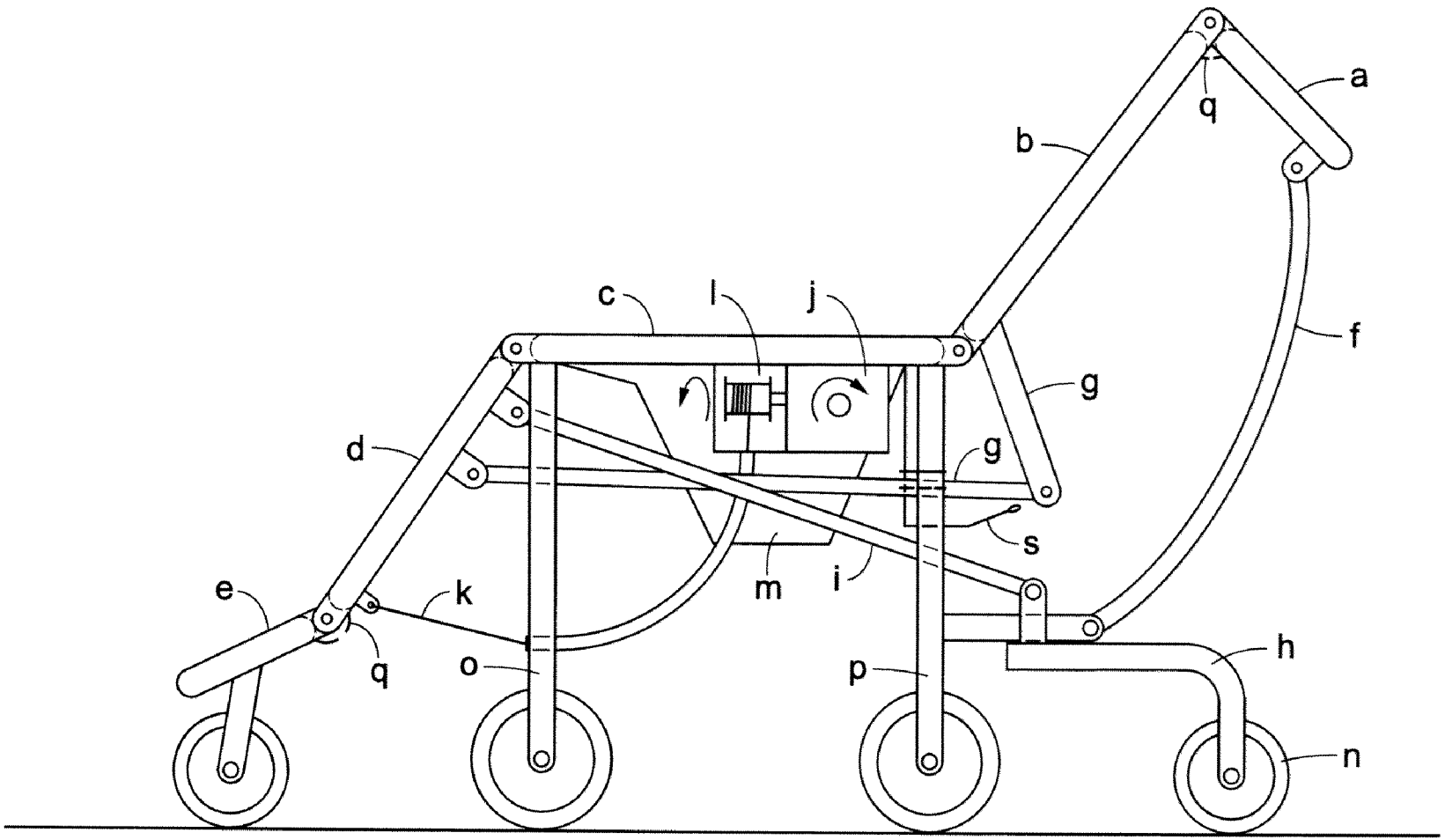
FIG. 1 illustrates the side view of the wheel chair with commode for a patient that covert in to a bed according to present invention.

The above, and the other objects, features & advantages of invention will become apparent from following description read in conjunction with the accompanying drawings.

Now referring to Figures, wheel chair of the present invention comprises outer main frame (c). This rectangular shaped frame stands on four wheeled legs (o, p). There may be more number of legs. This frame basically supports the hip portion of the patient's body. The wheel chair further comprises four more outer frames (a, b, d, e). These four frames are connected to each other by pivots or hinges. The frame (a) supports the head portion of the patient. This frame is connected to the rear legs (p) of the main frame (c) through a link (f) and to a frame (b) by a hinge (r). The frame (b) supports the upper body portion of the patient. It is connected to frame (d) via link (g). The frame (d) supports the leg portion of the patient and is connected to frame (e) by hinge (r). The stopper is provided at the hinge (r) to stop the further movement of the frames. Frame (e) supports the foot portion of the leg of the patient and is provided with caster wheel below it. The movements of frames (a, b, d, e) to convert chair into bed and vice-versa is controlled by gear box (j) along with cable (k) or gears (k11, k12). This gear box is provided beneath the main frame (c).

The additional wheels (n) are provided to prevent the chair or bed from tilting backward due to weight of frames (a, b). These additional wheels (n) are connected to frame (d) by means of links (i, h). These links pulls the additional wheels (n) either nearer to or far away from the rear wheels (p).

The wheel chair of the present invention can be converted in to a bed also. The width of the chair is 24" (aprox.). After converting the wheel chair into a bed, the width of the bed needs to be increased. The wheel chair of the present invention provides width of 36" (aprox.) in a bed position. This increase in the width is possible by inner frames (t). These inner frames (t) slidably fitted inside the outer frames (a, b, c, d, e). The outer frames of the present invention are made up of squared hollow pipes in which inner frames accommodated slidably. The inner frames (t) are pulled inside the outer frames (a, b, c, d, e) during use of wheel chair as a chair and pulled outside while using wheel chair as a bed to increase the dimension of the bed. Every inner frame is connected to adjacent inner frame using a hinge (x). The movement of inner frames (t) is controlled by the threaded rods (y). These rods (y) are attached to the frames by means of steel strips (z) and rivets or nut bolts. All threaded rods (y) of inner frames (t) are connected by a chain (u) and handle (w) assembly, so that they all turn together, a when handle (w) is turned.

The wheel chair of the present invention also comprises the commode pan or pot (m) being fitted under the main frame (c) with the help of hinge (r) and linkage (s). A cushion is provided between main frame (c) and commode pan or pot (m). The position of commode pan or pot (m) and cushion is controlled by a pair of gear boxes (j1, j2) in which one (j1) is provided near commode pan or pot and other (j2) is at the rear wheels of the outer main frame. These gear boxes are provided with gears (k1, k2).

All gearboxes used in present invention can be operated mechanically, electrically with electric motor, pneumatically with pneumatic force or hydraulically with hydraulic force.

The newly invented sliding back frame (B) is assembled on main frame (A) in such a way that it can slide up and down freely. The sliding back frame (B) is pulled up by cable (C) and pulled down by pulling spring (E). One end of the cable (C) is fitted to sliding back rest frame (B) and the other to main frame (A). One end of the pulling spring (E) is fitted to sliding back frame (B) and other to main frame (A).

Figure 9:
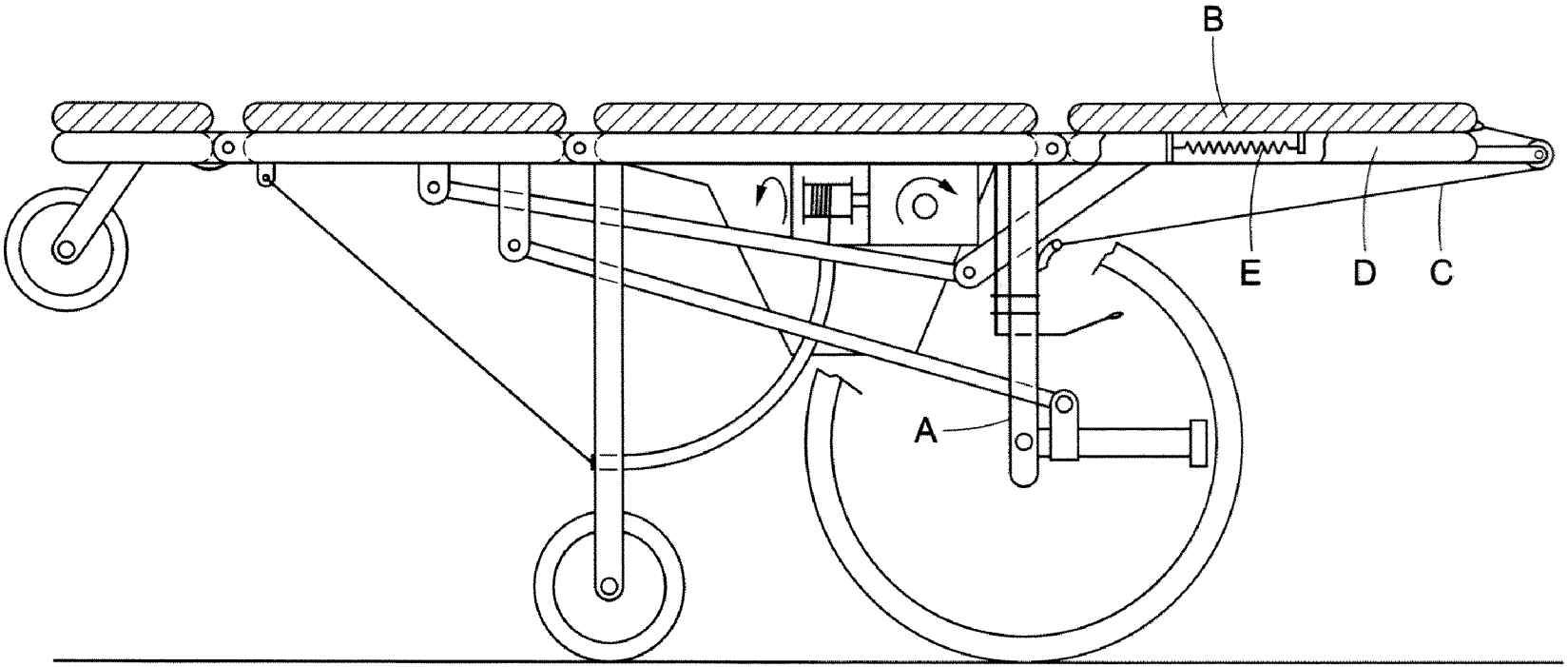
FIG. 9 illustrates the wheelchair with commode for a patient that converts into a bed with its back in almost a bed position with the newly sliding back fitted into it. The newly invented sliding back it at its original position.

FIG. 9 displays that when this chair is in bed position, the back of the wheelchair (D) is in horizontal position, the controlling cable (C) is relaxed, and the pulling spring (E) keeps the sliding back support frame (B) in lowest position. As such, there is hardly any gap between the frames.

Figure 10:
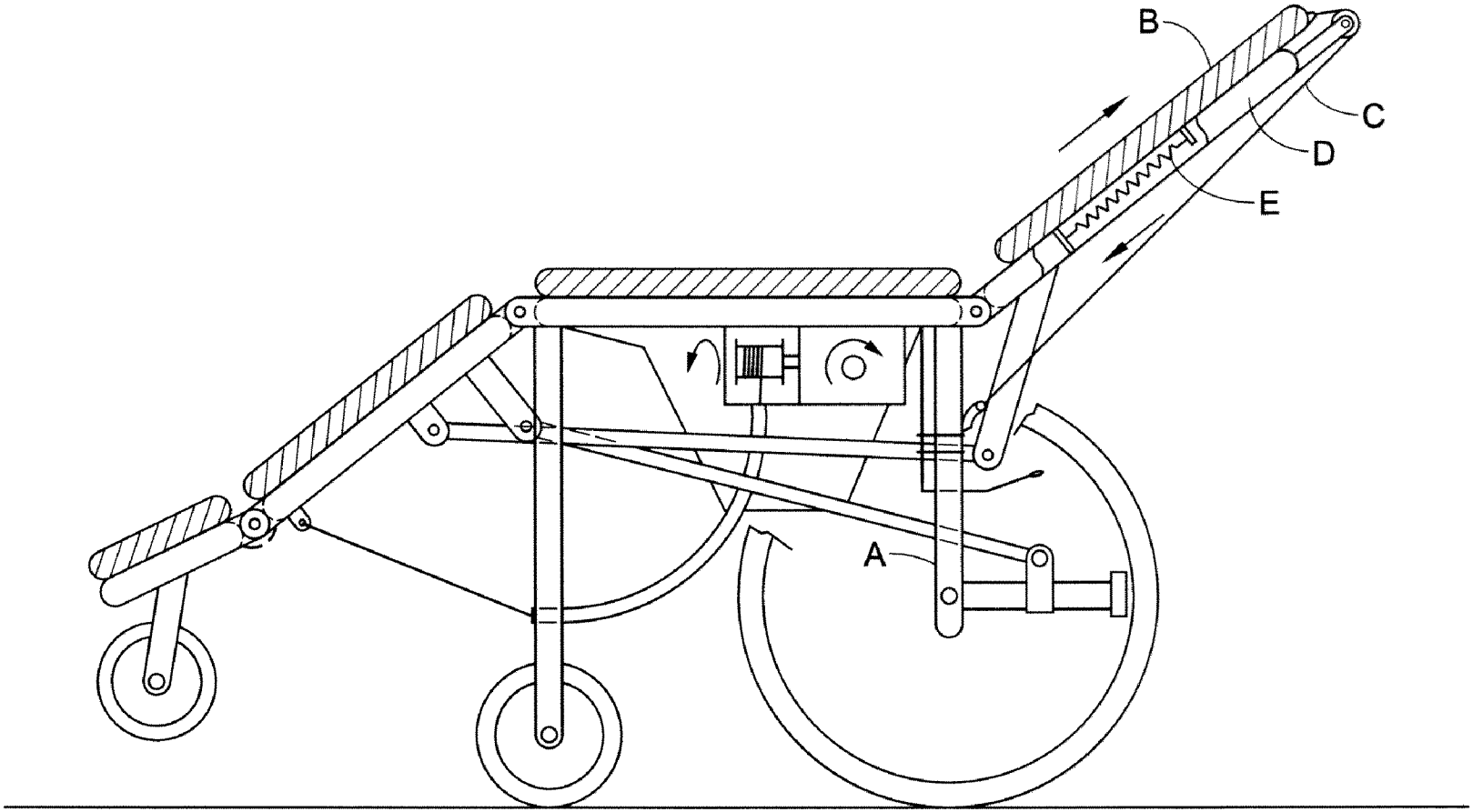
FIG. 10 illustrates the wheelchair with commode for a patient that converts into a bed with its back in an easy chair position with the newly sliding back fitted to it. The sliding back is slightly pulled up from its original position.

As shown in FIG. 10, when the convertible wheelchair starts turning into a chair position frame (D) starts moving upwards and comes to an easy chair position the control cable (C) pulls the sliding back support frame (B) upwards. As the upper body of the patient is resting on the sliding back support frame it moves up with the sliding back support frame. Thus, the patient is not pushed forward.

Figure 11:
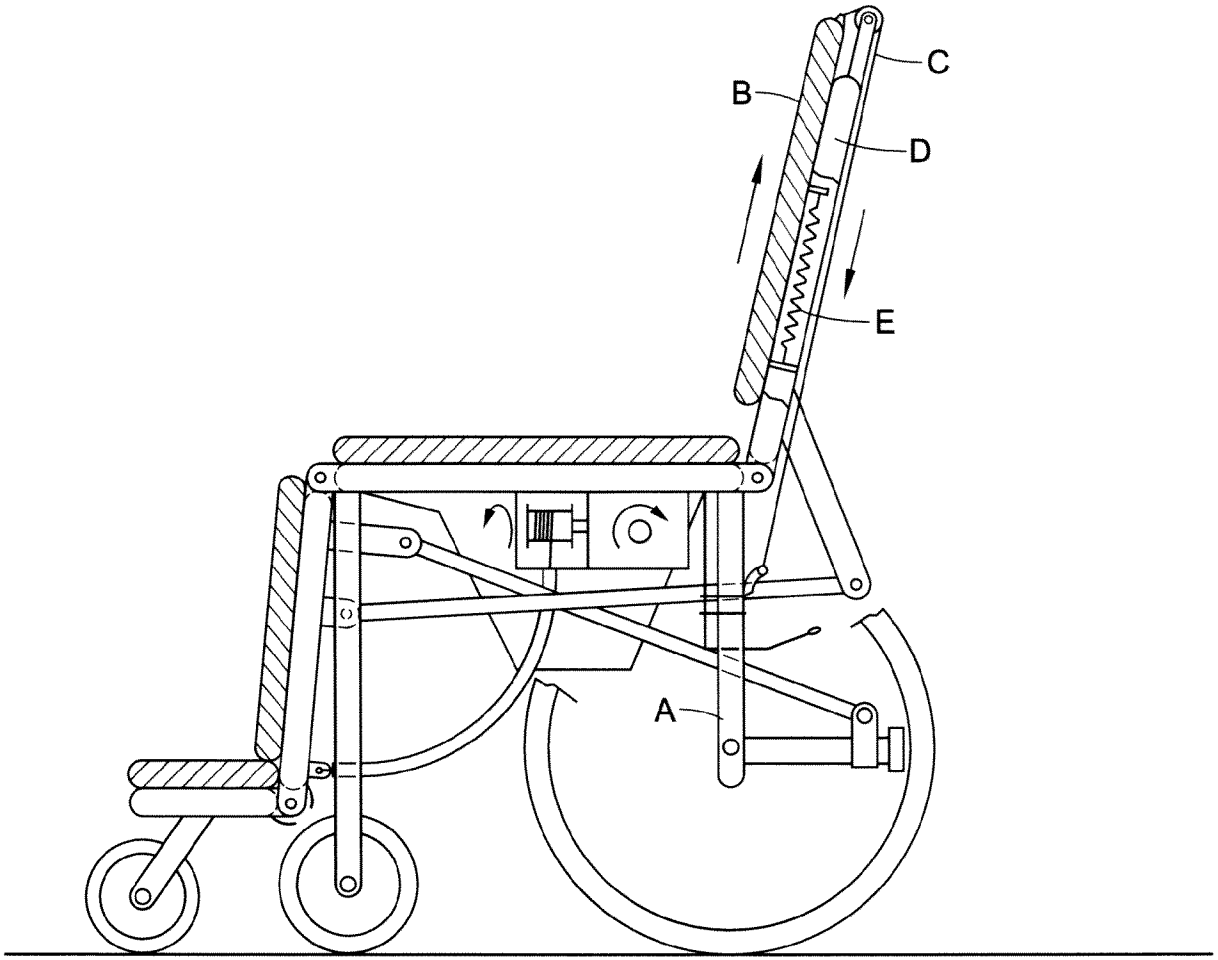
FIG. 11 illustrates the wheelchair with commode for a patient that converts into bed with its back in almost a chair position with the newly sliding back fitted into it. The newly invented sliding back is completely pulled up so as to maintain the position of the patient on the bed.

FIG. 11 displays that when the convertible wheelchair starts converting into a full chair position, the back frame (D) moves further upwards becoming almost vertical. The control cable (C) pulls the sliding back support frame fully upwards. As the upper body of the patient is resting on the sliding back support frame it moves up with the sliding back support frame. Thus, the patient is not pushed forward.

In an ordinary fowler bed, there is no relative movement between the patient and the back frame. In this novel arrangement between the sliding back frame and the main frame, there is a relative movement. The patient's upper body is resting on the sliding back frame. Therefore, the patient's body moves upwards with the sliding back frame, which has a relative movement with the main frame. Accordingly, the patient is not pushed forward.

In the chair position, the sliding back frame is kept in fully vertical (up) position, which is controlled by the cable. As the back (D) starts relaxing towards bed position the cable (C) loosens and allows the sliding back support frame (B) to slide downwards. The pulling spring (E) pulls it downwards so it moves down. As the back support frame goes into horizontal position, the pulling spring (E) brings the sliding back support frame (B) to fully down position. As the upper portion of the patient's body is on the sliding back support frame his/her upper body moves up and down with the support frame.

One advantages of the of the newly invented sliding back is that the patient is prevented from being pushed forward every time the back of the bed is moved in an upright position. Thus, the patient maintains his position on the bed and does not have to be pulled up every time. This saves a lot of trouble for the nurse/family members and a lot of pain for the patient.

The sliding back according to the present application prevents the patient from being pushed forward every time the back of the bed is moved in an upright position and helps the patient to maintain his position on the fowler (hospital) bed.

Figure 2:
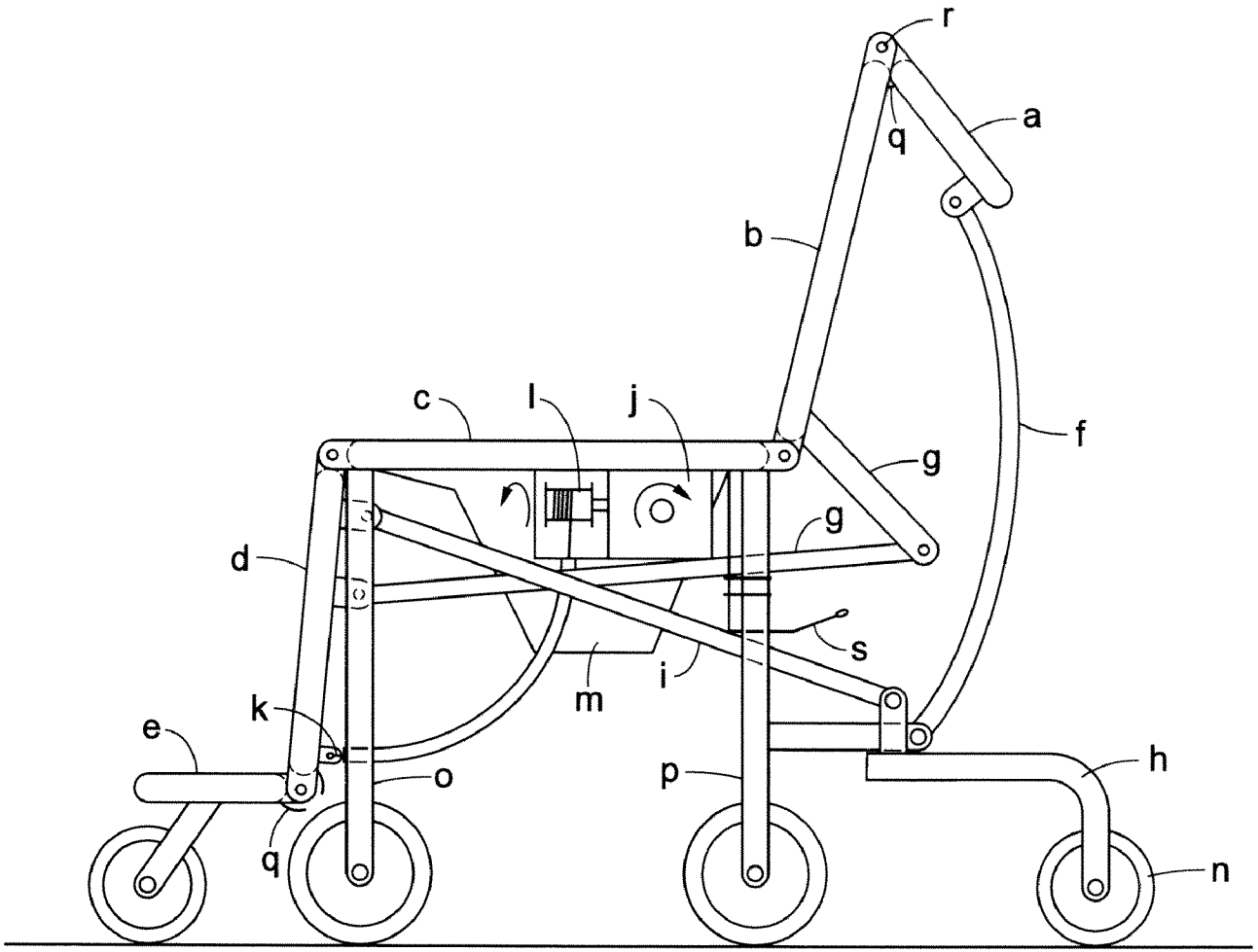
FIG. 2 illustrates the side view of the wheel chair when it is used as a chair.
Figure 3:
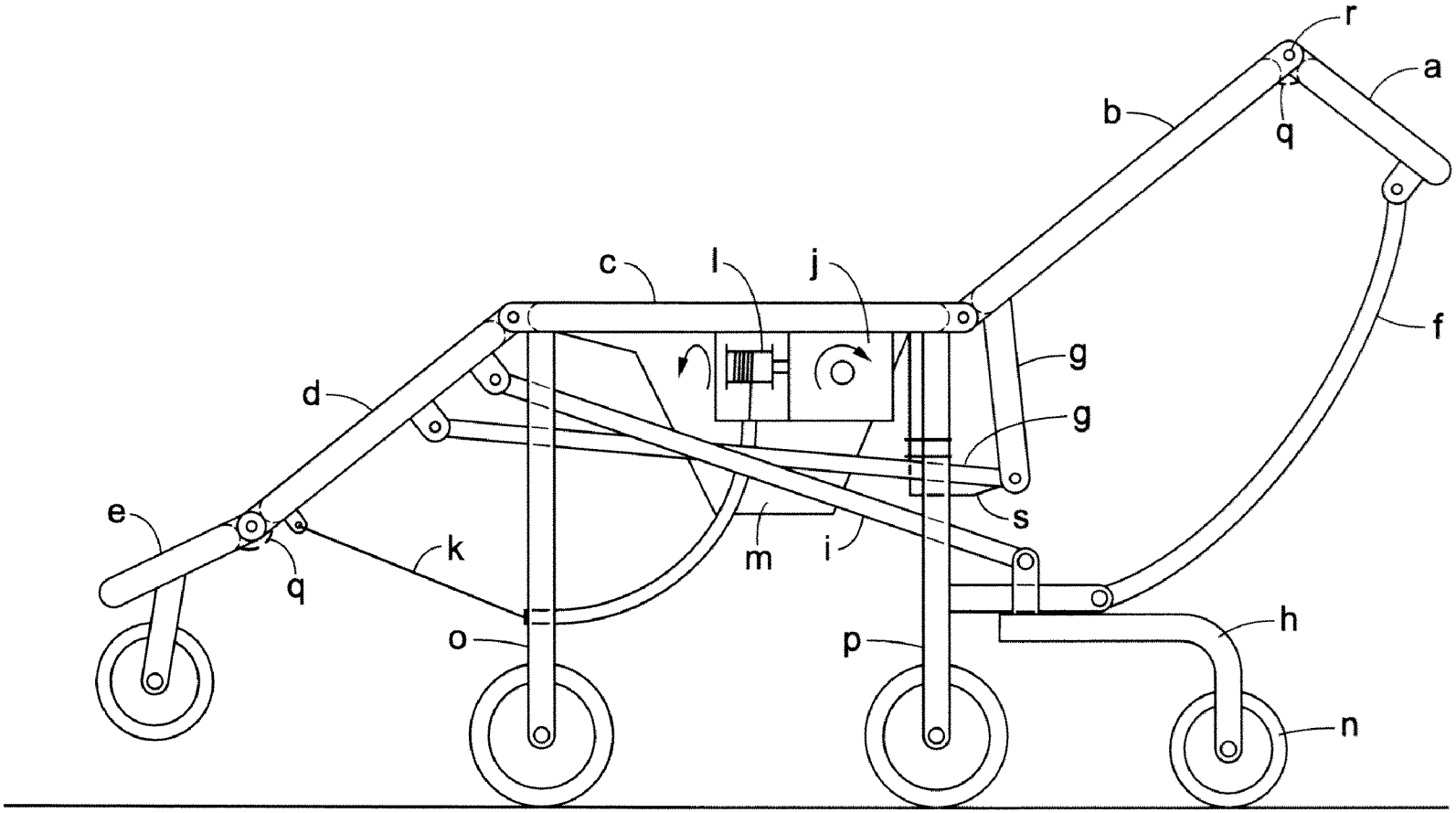
FIG. 3 illustrates the side view of the wheel chair when it is used as an easy chair.
Figure 4:
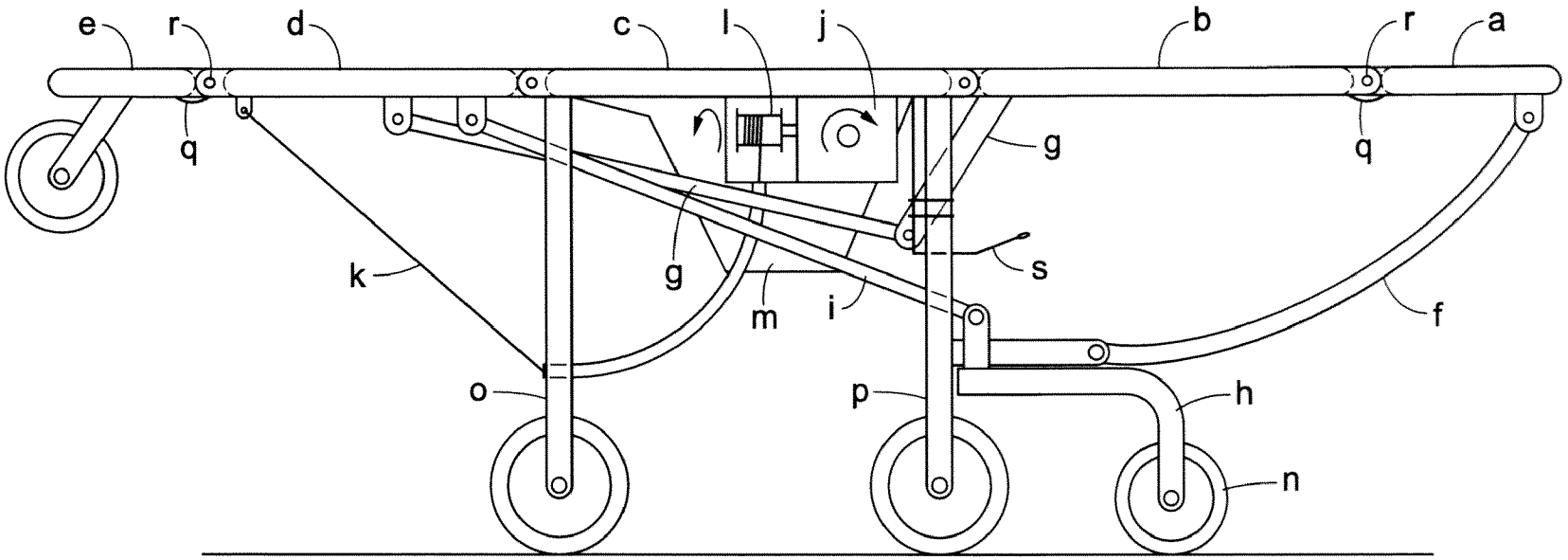
FIG. 4 illustrates the side view of the wheel chair when it is used as a bed.

This sliding back is useful for the aged, permanently or temporary disabled, spastic, paralyzed or patients whose movements are restricted for some other reason. This newly invented sliding back is useful in hospitals, to private nurses and the family members who nurse a bed-ridden patient. The wheel chair according to the present invention may have various application modes, for example:

i. Chair;
ii. Easy chair;
iii. Bed; and
iv. Commode i. Chair:

Referring to FIG. 2, the drive shaft of the gear box (j) is turned to wind cable (k) fully in winder (I). This cable pulls frame (d) towards front legs (o) of the chair. Frame (d) and frame (b) are connected by linkage (g). This linkage pushes frame (b) into an upright position. Frame (a) is connected to the rear legs (p) of the chair through link (f), due to which frame (a) is folded backwards. Frame (e) has caster wheel below. As the caster wheel touches the ground, frame (e) is pushed to almost a right angle position with frame (d). Additional wheels (n) are pulled nearer to rear wheels (p) of the chair.

ii. Easy Chair:

Referring to FIG. 3, the weight of frame (a), (b) and linkage (g) naturally tends to be in horizontal position. As the gear box (j) shaft is turned to unwind cable (k), it allows frame (d) to move away from front legs (o) of the chair. Due to the weight of frame (b) and (a), both the frames (a) and (b) start traveling towards horizontal position. Frame (d) provides supports for legs, frame (c) provides sitting and frame (b) provides back rest. In the process of unwinding cable (k), these frames (b) and (d) can be stopped at different positions of comfort. Additional wheels (n) starts moving away from rear legs (p) due to linkage (i+j). These additional wheels stop the chair from tilting backwards due to weight of frames (a), (b) and the patient. In this way chair can be converted into easy chair.

iii. Bed:

As shown in FIG. 4, further unwinding of cable (k), by turning gear box (j), allows frame (d) to become horizontal in position. Frame (e) is connected to frame (d) by hinges (r) and a stopper (q). Frame (e) is pulled up with frame (d) and is stopped by stopper (q) at a parallel position to frame (d). Frames (b) and (a) travel further to a horizontal position by weight. As frame (b) and (d) are linked, both become horizontal and parallel. Frame (a) also travels down with frame (b). Frame (a) is connected to frame (b) by hinge (r). As frame (a) comes down with frame (b), linkage (f) pushes it to a horizontal position. As a result of fully unwinding cable (k) frames (a, b, c, d, e) become horizontal and parallel, and thus the chair converts into a comfortable bed. The additional wheels (n) are pushed fully away from the rear legs (p) of wheel chair, due to linkage (h+i). These additional wheels provide stability, stops the bed from toppling and thus the bed becomes stable with the available wheels. The length of the bed becomes 78" (aprox.) or more.

Figure 5A:
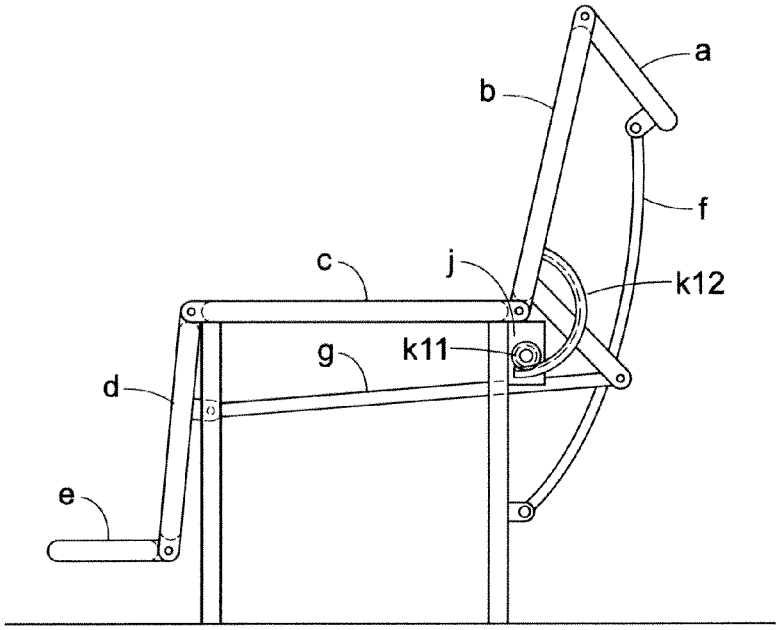
FIGS. 5(*a*) & 5(*b*) illustrate how gear boxes and gears used for converting wheel chair into bed.
Figure 5B:
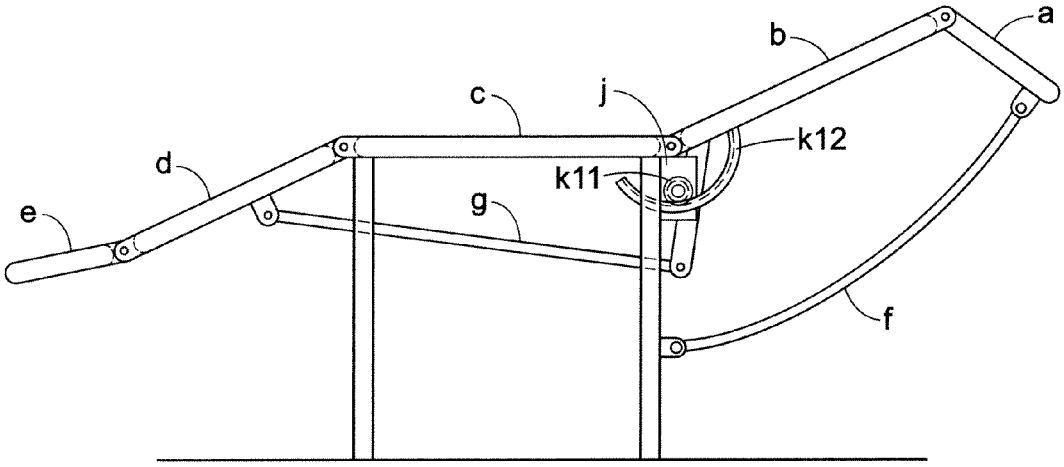

It is already explained how winding and unwinding of cable can convert the wheel chair into easy chair and bed and vice-versa. FIGS. 5(*a*) and 5(*b*) will explain how this can be done with gear box and gears. A gear box (j) is fitted to wheel chair frame (c). This gear box contains driving gear (k11). The driven gear (k12) is welded into frame (b). As the driving gear (k11) is turned into one direction, it pulls the driven gear (k12). The driven gear (k12) being welded to frame (b), pulls down frame (b). As frame (b) is connected to frame (d) through linkage (g), frame (d) is pushed upwards. As frame (a) is connected to wheel chair frame (c) through linkage (f), frame is pushed towards a horizontal position. Further turning of driving gear (k11) will thus get the wheel chair into easy chair position. Further turning of driven wheel (k12) will get all frames into a straight horizontal line. This is how a wheel chair will be converted into a flat bed. Turning of driving gear (k11) into opposite direction will fold the different frames of the bed, thus converting the bed back into a wheel chair.

The width of the chair is 24". After converting it into bed position, the width of the bed needs to be increased. Frames (a, b, c, d, e) are made of hollow square pipes. They are made in such a way that smaller frames (t) i.e. inner frames can slide inside the square pipes. Theses frames (t) are controlled by the threaded rods or jacks (y). Frames (t) are controlled by the threaded rods, by steel strips (z) and rivets or nut-bolts. These frames (t) are attached to nuts which fit on threaded rods or jackets (y). As the threaded rods (y) are turned, the nuts move to and fro (backward and forward) pushing steel strips, which push the sliding inner frames (t), towards or away from frames (a, b, c, d, e).

All the threaded rods or jacks (y) are connected by a chain, so they all turn together, when handle (w) is turned.

Figures 6A, 6B, 6C:
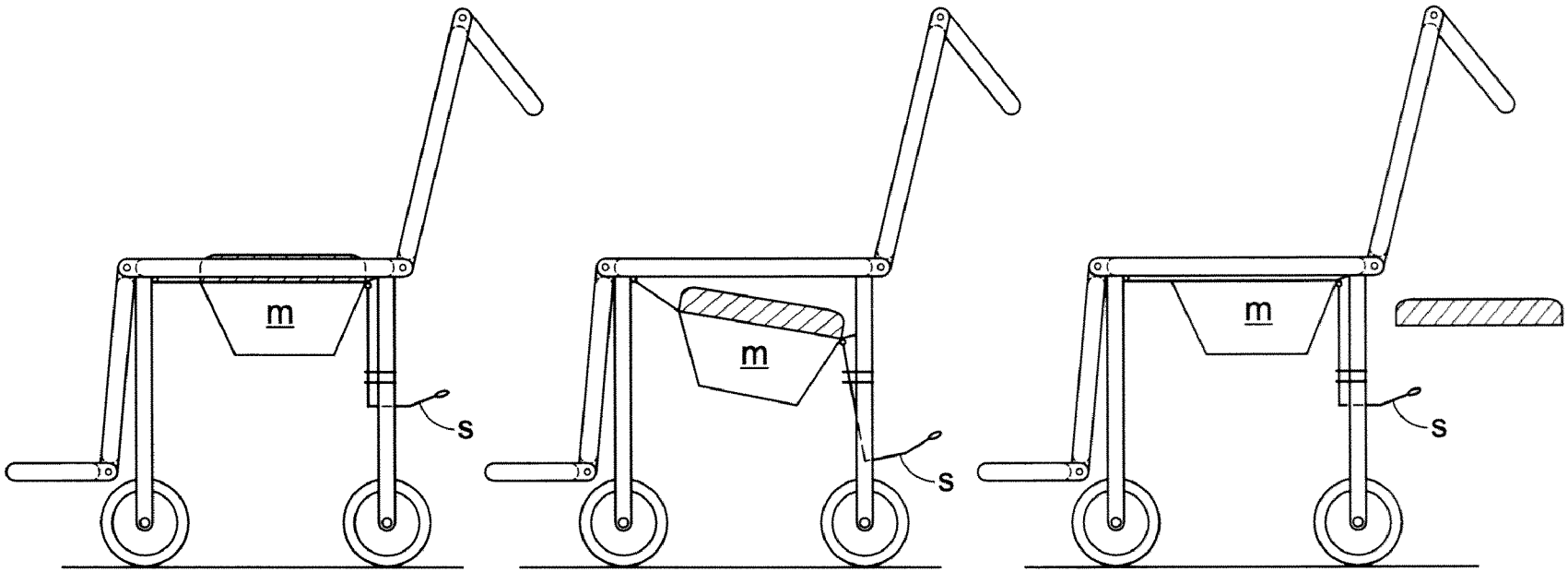
FIGS. 6(*a*) to 6(*c*) illustrate the wheel chair with different operative positions of the commode.
Figure 7A:
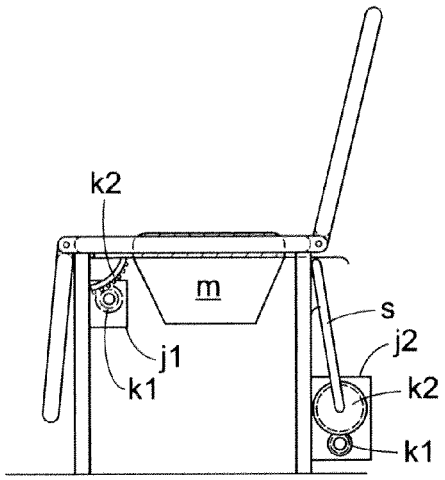
FIGS. 7(*a*) to 7(*d*) illustrate how gear boxes and gears used for removing of cushion pads and use of commode pan or pot.
Figure 7B:
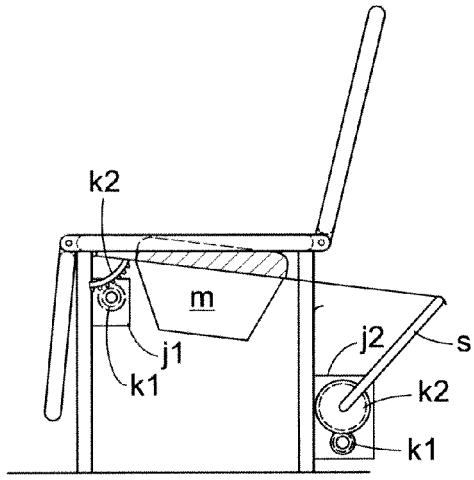
Figure 7C:
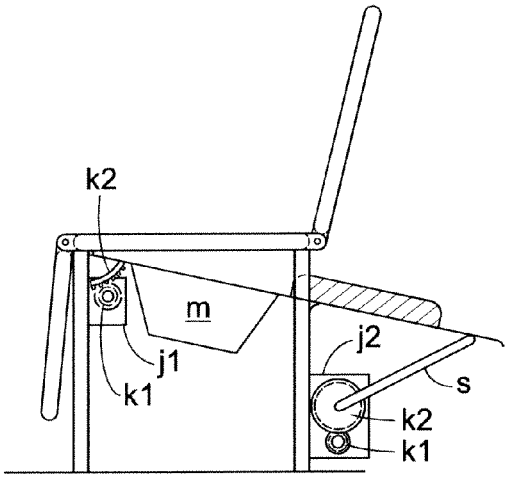
Figure 7D:
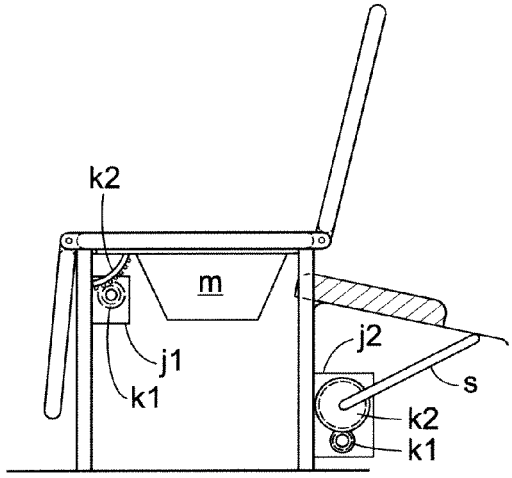
Figure 8A:
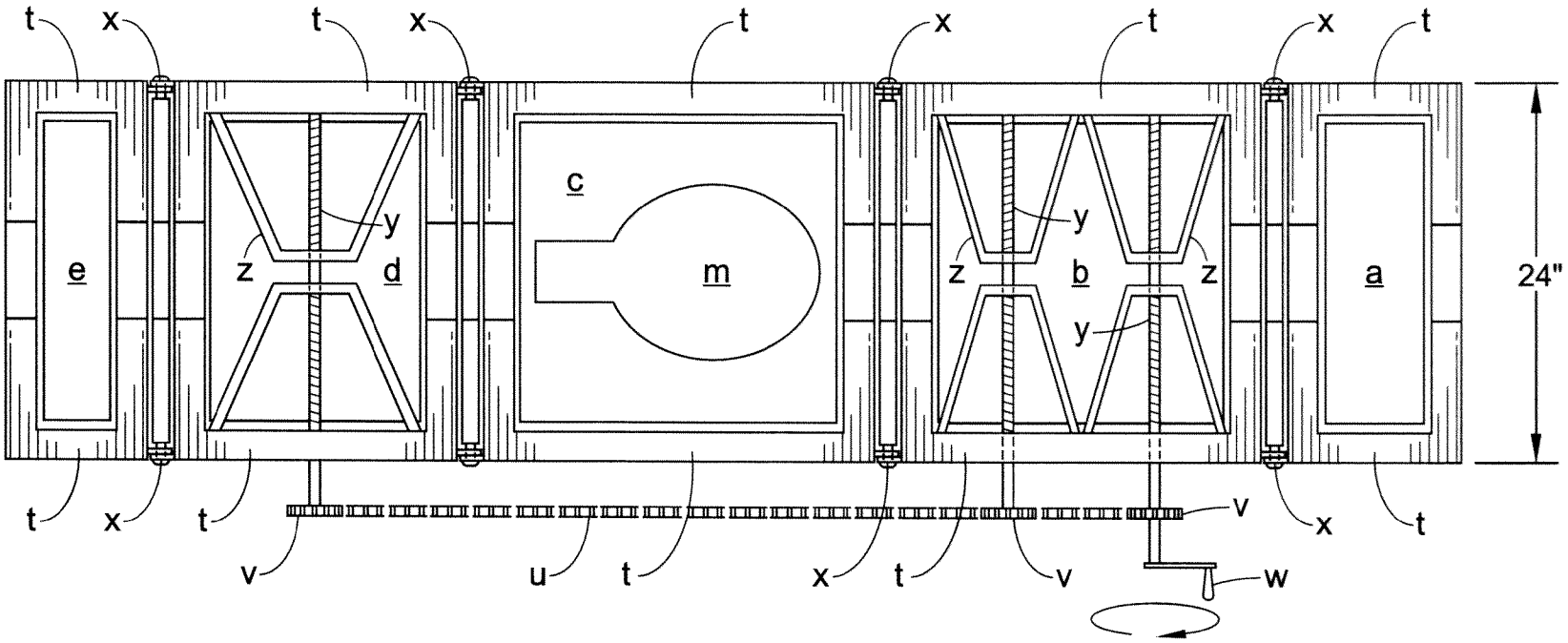
FIGS. 8(*a*) & 8(*b*) illustrate how width of the bed is changed using inner frames.
Figure 8B:
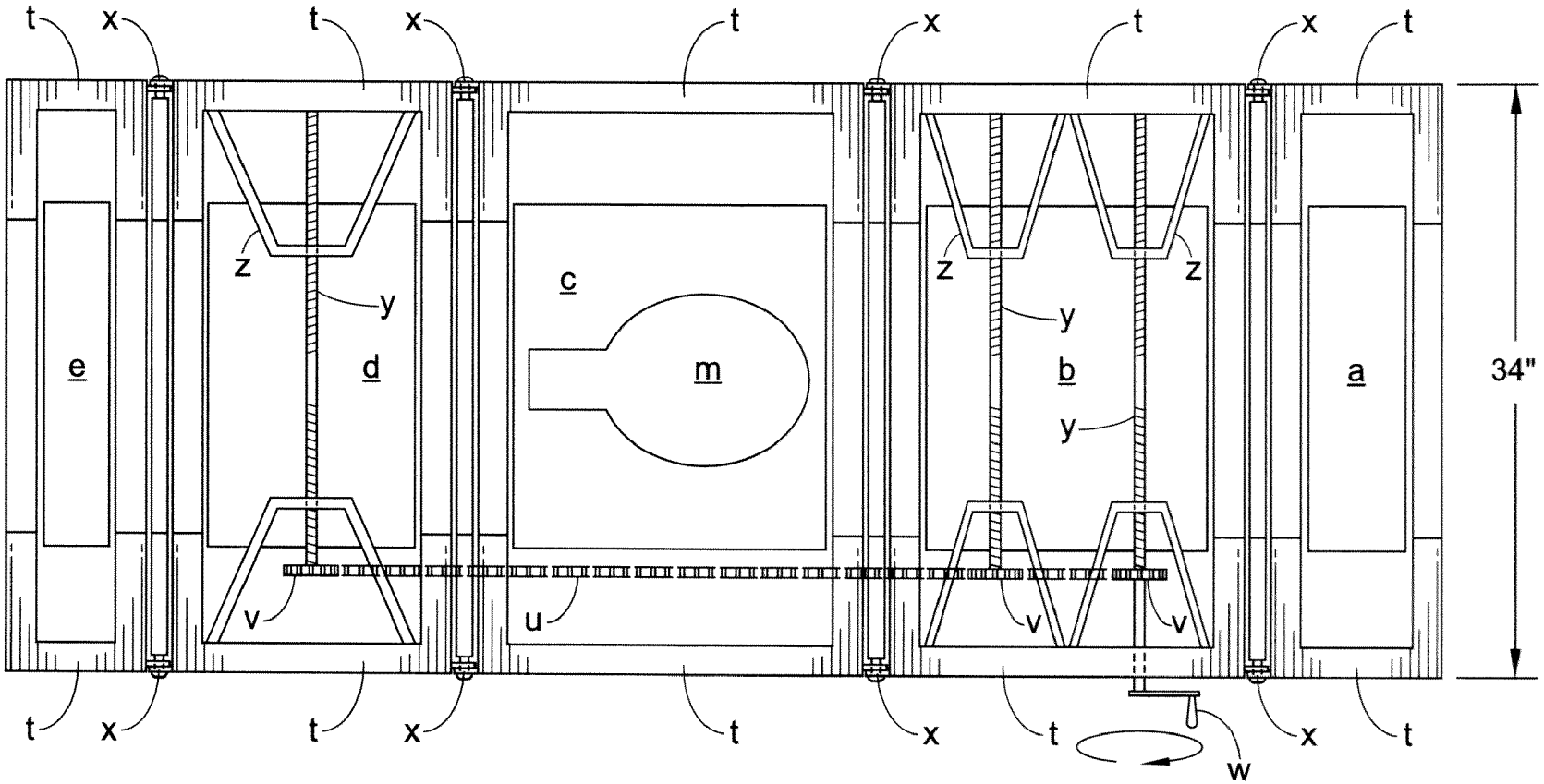

When the structure is in chair form, the inner frames are pulled in to make the width of chair to 24". When the chair is converted into bed, the threaded rods are turned and inner frames (t) are pushed away from frames (a, b, c, d and e). This pushing away of the inner frames (t) makes the width of bed at around 36". Thus the chair is converted into 36" wide comfortable bed.

iv. Commode:

As shown in FIGS. 6(*a*), 6(*b*) and 6(*c*), a pan is fitted below frame (c). This pan is connected to frame (c) by hinges (r) and controlling linkage (s). When controlling linkage (s) is pulled, the pan is lowered down. The pan gets lowered from the bed along with the cushion padding. The cushion padding can be separated from the pan, when the pan is to be used. By pushing the controlling linkage (s), the pan gets shifted back (without padding cover) to its position and is now ready for use. All these actions/functioning of different parts in reverse order will convert the bed back to the chair position. By winding the cable with the help of the gear box, frame (d) is pulled towards the front legs (o) of the wheel chair and through linkages (f, g, h, i) the bed converts back into wheel chair.

As shown in FIGS. 7(*a*) to 7(*d*) two gear boxes (j1, j2) are fitted on wheel chair frame. Driving shaft (k1) in gear box (j1) is turned in one direction to lower the pan with cushion pad. When the pan is lowered, one end of the cushion pad support locks on to one end of linkage (s). Driving gear (k2) in gear box (j2) is turned into one direction to pull out cushion pad and support plate. This uncovers the bed pan. Now the driving gear (k1) in gear box (j1) is turned into opposite direction to push the uncovered pan back into position, for use. All the above mentioned actions, when done in a reverse order will help the pan and cover pad into its original position.

The frames and other components of the wheel chair can be manufactured by using metals like aluminum, stainless steel, copper, brass or its alloys. All the parts may be made from materials like rubber, plastic, nylon, Teflon, fiber or other synthetic material to reduce the weight of the bed. The bed of the present invention can be manufactured in various sizes suitable for different sizes of persons/patients.

The Wheel Chair According to the Present Embodiments Displays at Least the Following Advantages:

1. The wheel chair of the present invention has number of frames which can change angles to form a complete bed position. These frames can also change angles to form an easy chair position for comfort;
2. The bed of the present invention has a built in commode;
3. This eliminates manual labor required for shifting of a patient; and
4. This eliminates the risk of the patient from slipping and falling down.

The multipurpose wheel chair of the present invention can be used as a chair as well as bed. This multipurpose wheel chair is useful for the aged, permanently or temporary disabled, spastic, paralyzed or patients whose movements are restricted for some other reason. This wheel chair is useful in hospitals, to private nurses and the family members who nurse a bedridden patient. It makes their job easy, safe and stress-free.

The present invention is not limited to the above described embodiments, and various changes may be made, if desired, without departing from the essence or spirit of the invention which can be read from the claims and the entire specification. All these changes are also intended to be within technical scope of the present invention.

I claim:

1. A wheelchair with a commode that converts into a bed comprising:

a. an outer rectangular main frame standing on at least four wheeled legs, said frame supporting a hip portion of a patient's body;

b. four outer frames being operatively connected to each other by pivots or hinges, out of these four frames, the first frame supporting the head portion of the patient's body, the second frame supporting the upper body portion of the patient's body, the third frame supporting the leg portion of the patient's body, the fourth frame supporting the foot portion of the legs of the patient's body, said main frame being disposed between the second and third frames, said first frame being operatively connected to rear legs of the main frame through a link and to said second frame by a hinge, said second frame being operatively connected to the third frame through another link, said third and fourth frames being connected to each other by a hinge, said fourth frame being provided with a caster wheel below it;

c. a pair of additional wheels being operatively connected to said third frame by means of links, said links pulling the additional wheels either nearer to or farther away from the rear wheels of said main frame, said additional wheels preventing said wheelchair from tilting backward due to the weight of said first and second frames and the patient;

d. means for making movements of said first, second, third and fourth frames to convert said wheelchair into a bed or vice-versa, said means being attached to the main frame from down side, said means comprising a gear box along with gears or cables;

e. inner frames being slidably fitted inside the outer frames, said inner frames being pulled inside the outer frames during use of the wheelchair as a chair and pulled outside while using said wheelchair as a bed to increase the dimension of the bed; and f. a commode pan or pot being fitted under the main frame with a hinge and linkage arrangement, a cushion disposed between said main frame and said commode pan or pot, the position of said commode pan or pot and cushion being controlled by a pair of gear boxes in which one is provided near said commode pan or pot and the other is at the rear wheels of the outer main frame.

2. A wheelchair as claimed in claim 1, wherein said outer frames are made up of hollow square pipes.

3. A wheelchair as claimed in claim 1, wherein the movement of the inner frame is controlled by the threaded rods, said rods are attached to the frames by means of steel strips and rivets or nut bolts.

4. A wheelchair as claimed in claim 1, wherein all said threaded rods of inner frames are connected by a chain and handle assembly, so that they all turn together, when the handle is turned.

5. A wheelchair as claimed in claim 1, wherein said gearboxes are operated mechanically.

6. A wheelchair as claimed in claim 1, wherein said gearboxes are operated electrically with an electric motor.

7. A wheelchair as claimed in claim 1, wherein said gear boxes are operated pneumatically with pneumatic force.

8. A wheelchair as claimed in claim 1 wherein said gear boxes are operated hydraulically with hydraulic force.

9. A wheelchair with a sliding back comprising:

a steel frame with at least one cushion on which an upper body of a patient rests;

at least one cable that pulls the sliding back upward when the sliding back is moved in a chair position, wherein one end of said at least one cable is coupled to said sliding back and the other end is coupled to said steel frame; and one or more springs that pull the sliding back to its original position of a bed so as to maintain the position of the patient on the bed, wherein one end of each of said one or more springs is coupled to said sliding back and the other end is coupled to said steel frame.

10. The wheelchair of claim 9, further comprising means for preventing a sliding forward of the patient on the bed so as to maintain the position of the patient on the bed.

11. The wheelchair of claim 9, wherein the frames frame and other components of the bed comprise metals such as aluminum, stainless steel, copper, brass or their alloys.

12. The wheelchair of claim 9, wherein the wheelchair comprises at least one of rubber, plastic, nylon, Teflon, fiber or other synthetic material to reduce the weight of the bed.

13. The wheelchair of claim 9, wherein the movements of the frames and mechanisms is performed mechanically by mechanical power, electrically by electric power, hydraulically by hydraulic power and pneumatically by pneumatic power.

* * * * *